US010642181B2

(12) United States Patent
Kamiyoshi et al.

(10) Patent No.: US 10,642,181 B2
(45) Date of Patent: May 5, 2020

(54) LIQUID DEVELOPER

(71) Applicant: Kao Corporation, Tokyo (JP)

(72) Inventors: Nobumichi Kamiyoshi, Wakayama (JP); Tatsuya Yamada, Wakayama (JP); Taiki Yamamoto, Osaka (JP); Kunihiro Kano, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 16/326,995

(22) PCT Filed: Aug. 25, 2017

(86) PCT No.: PCT/JP2017/030521

§ 371 (c)(1),
(2) Date: Feb. 21, 2019

(87) PCT Pub. No.: WO2018/043327

PCT Pub. Date: Mar. 8, 2018

(65) Prior Publication Data

US 2019/0171126 A1 Jun. 6, 2019

(30) Foreign Application Priority Data

Aug. 31, 2016 (JP) ..... 2016-169892

(51) Int. Cl.

| | |
|---|---|
| ***G03G 9/097*** | (2006.01) |
| ***G03G 9/13*** | (2006.01) |
| ***G03G 9/135*** | (2006.01) |
| ***G03G 9/125*** | (2006.01) |

(52) U.S. Cl.

CPC ..... *G03G 9/132* (2013.01); *G03G 9/125* (2013.01); *G03G 9/13* (2013.01); *G03G 9/131* (2013.01); *G03G 9/135* (2013.01)

(58) Field of Classification Search

CPC ..... G03G 9/125

See application file for complete search history.

(56) References Cited

U.S. PATENT DOCUMENTS

| | | | | |
|---|---|---|---|---|
| 2003/0104304 | A1* | 6/2003 | Nicholls | G03G 9/122 430/116 |
| 2012/0009516 | A1 | 1/2012 | Ganapathiappan et al. | |
| 2015/0198903 | A1 | 7/2015 | Deroover et al. | |

FOREIGN PATENT DOCUMENTS

| | | | | |
|---|---|---|---|---|
| JP | 2003-195573 | A | 7/2003 | |
| JP | 2011-27845 | A | 2/2011 | |
| JP | 2013-114208 | A | 6/2013 | |
| JP | 2015-127735 | * | 7/2015 | G03G 9/12 |
| JP | 2015-127735 | A | 7/2015 | |
| JP | 2015-135475 | * | 7/2015 | G03G 9/12 |
| JP | 2015-135475 | A | 7/2015 | |

OTHER PUBLICATIONS

Translation of JP 2015-135475.*
Translation of JP 2015-127735.*
International Search Report dated Oct. 31, 2017 in PCT/JP2017/030521, 2 pages.
European Search Report dated Feb. 21, 2020, in European Patent Application No. 17846332.9.

* cited by examiner

*Primary Examiner* — Peter L Vajda
(74) *Attorney, Agent, or Firm* — Oblon, McClelland, Maier & Neustadt, L.L.P.

(57) ABSTRACT

A liquid developer containing toner particles containing a resin binder containing a polyester-based resin and a colorant, a dispersant, and an insulating liquid, wherein the dispersant contains a dispersant X having an adsorbing group having a nitrogen-containing group represented by the formula (I):

(I)

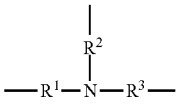

wherein each of $R^1$, $R^2$, and $R^3$, which may be identical or different, is an alkylene group having 1 or more carbon atoms and 22 or less carbon atoms, an alkenylene group having 2 or more carbon atoms and 22 or less carbon atoms, an alkynylene group having 2 or more carbon atoms and 22 or less carbon atoms, or an arylene group having 6 or more carbon atoms and 22 or less carbon atoms, and a dispersing group having a hydrocarbon group having a number-average molecular weight of 500 or more, and wherein the dispersant X has a mass ratio of the adsorbing group to the dispersing group (adsorbing group/dispersing group) of 1/99 or more and 42/58 or less, and a proportion of the dispersing group having a hydrocarbon group having a number-average molecular weight of 500 or more in all the dispersing groups of 55% by mass or more. The liquid developer of the present invention is suitably used in development or the like of latent images formed in, for example, electrophotography, electrostatic recording method, electrostatic printing method or the like.

20 Claims, No Drawings

LIQUID DEVELOPER

FIELD OF THE INVENTION

The present invention relates to a liquid developer usable in development of latent images formed in, for example, electrophotography, electrostatic recording method, electrostatic printing method or the like.

BACKGROUND OF THE INVENTION

As electrophotographic developers, a dry developer in which toner components composed of materials containing a colorant and a resin binder are used in a dry state, and a liquid developer in which toner components are dispersed in an insulating liquid have been known.

In a liquid developer, toner particles are dispersed in oil in an insulating liquid, thereby making it possible to form smaller particle sizes as compared to a dry developer. Therefore, high-quality printouts can be obtained surpassing offset printing, so that the liquid developer is suitable for commercial printing applications.

Patent Publication 1 discloses a liquid developer containing at least toner particles, a carrier liquid, and a dispersant, characterized in that the dispersant comprises a succinic acid imide compound and a fluorine-containing silane compound.

Patent Publication 2 discloses a liquid toner dispersion provided with marking particles comprising a pigment, and a polyester-based resin such as a polyester-based resin, the dispersion comprising a nonpolar organic carrier liquid and a hyper-dispersant comprising a graft copolymer provided with an anchor group comprising an amine-functionalized polymer onto which stabilizing groups are grafted, which anchor group is anchored on a surface of a marking particle, wherein a first stabilizing group and a second stabilizing group are grafted to the anchor group, wherein the first stabilizing group is a fatty acid compound and the second stabilizing group is a polyolefin.

Patent Publication 1: Japanese Patent Laid-Open No. 2011-027845

Patent Publication 2: Japanese Patent Laid-Open No. 2015-135475

SUMMARY OF THE INVENTION

The present invention relates to a liquid developer containing toner particles containing a resin binder containing a polyester-based resin and a colorant, a dispersant, and an insulating liquid, wherein the dispersant contains a dispersant X having an adsorbing group having a nitrogen-containing group represented by the formula (I):

(I)

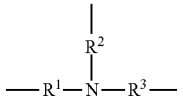

wherein each of $R^1$, $R^2$, and $R^3$, which may be identical or different, is an alkylene group having 1 or more carbon atoms and 22 or less carbon atoms, an alkenylene group having 2 or more carbon atoms and 22 or less carbon atoms, an alkynylene group having 2 or more carbon atoms and 22 or less carbon atoms, or an arylene group having 6 or more carbon atoms and 22 or less carbon atoms, and a dispersing group having a hydrocarbon group having a number-average molecular weight of 500 or more, and wherein the dispersant X has a mass ratio of the adsorbing group to the dispersing group (adsorbing group/dispersing group) of 1/99 or more and 42/58 or less, and a proportion of the dispersing group having a hydrocarbon group having a number-average molecular weight of 500 or more in all the dispersing groups of 55% by mass or more.

DETAILED DESCRIPTION OF THE INVENTION

A dispersant having a high molecular weight has a high adsorbability to toner particles; however, crosslinking between the particles by the dispersant takes place, so that dispersibility of the toner particles is lowered.

On the other hand, a dispersant having a low molecular weight has excellent dispersibility but its adsorbability to toner particles is low, so that chargeability is lowered due to the influence of the dispersant released in an insulating liquid. In particular, in a case where a resin binder is a polyester-based resin, many polar groups are contained, so that its polarity is high, thereby making the lowering of chargeability remarkable.

Therefore, a liquid developer having high dispersion stability of toner particles and high chargeability has been desired.

The present invention relates to a liquid developer having excellent dispersion stability and chargeability of the toner particles.

The liquid developer of the present invention exhibits some excellent effects in dispersion stability and chargeability of toner particles.

In order to increase dispersion stability and chargeability of the liquid developer, a dispersant having high adsorbability and high dispersibility has been desired.

In order to increase adsorbability of the dispersant, an acid-base interaction between a carboxylic acid which is an adsorbing site on the surface of the toner particles and a basic functional group owned by an adsorbing group of the dispersant must be strengthened. As a result of intensive studies, it has been found that a secondary amine or a tertiary amine is effective as a dispersant having an adsorbing agent having a strong interaction with a carboxylic acid.

In addition, in order to more easily progress the adsorption, it is important to minimize the change in forms before and after the adsorption (entropy loss), and as a result of intensive studies, it has been found that it is effective to introduce a large number of branched structures to adsorbing groups.

On the other hand, in order to increase dispersibility, it is important to increase affinity between a dispersing group and an insulating liquid, and as a result of intensive studies, it has been found that a long-chained hydrocarbon group having a structure similar to an insulating liquid is effective. In addition, it is also important to reduce interactions between dispersing groups themselves, and as a result of intensive studies, it has been found that the dispersion group having a multi-branched structure is effective.

In view of the above, in the present invention, it has been found that both dispersion stability and chargeability of the toner particles can be accomplished by a dispersant in which a long-chained hydrocarbon group is used as a dispersing group, and a nitrogen-containing group having a branched structure is used as an adsorbing group.

The liquid developer of the present invention is a liquid developer containing toner particles, a dispersant, and an insulating liquid.

The toner particles contain a resin binder containing a polyester-based resin and a colorant. While the polyester-based resin has excellent low-temperature fusing ability, the polyester-based resin has polar groups such as carboxy groups, hydroxyl groups, and ester groups, so that the polyester-based resin is less likely to disperse in a nonpolar solvent. However, in the present invention, since the dispersant has a nitrogen-containing group having a branched structure as an adsorbing group, the toner particles can be stably dispersed even when a polyester-based resin is used.

The polyester-based resin includes polyester resins, composite resins containing polyester resins and other resins such as styrenic resins, and the like.

In the present invention, it is preferable that the polyester resin is a polycondensate of an alcohol component containing a dihydric or higher polyhydric alcohol and a carboxylic acid component containing a dicarboxylic or higher polycarboxylic acid compound.

The dihydric alcohol includes, for example, aliphatic diols having 2 or more carbon atoms and 20 or less carbon atoms, and preferably having 2 or more carbon atoms and 15 or less carbon atoms; an alkylene oxide adduct of bisphenol A represented by the formula (II):

(II)

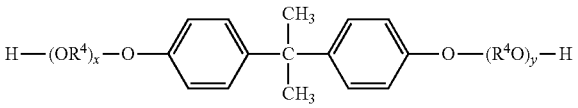

wherein $RO^4$ and $OR^4$ are an oxyalkylene group, wherein $R^4$ is an ethylene group and/or a propylene group; and each of x and y is a positive number showing an average number of moles of alkylene oxide added, wherein a value of the sum of x and y is 1 or more, and preferably 1.5 or more, and 16 or less, preferably 8 or less, more preferably 6 or less, and even more preferably 4 or less. Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably 1,2-propanediol or an alkylene oxide adduct of bisphenol A represented by the formula (II), from the viewpoint of improving pulverizability of the toner, thereby obtaining toner particles having a smaller particle size, from the viewpoint of improving low-temperature fusing ability of the toner, and from the viewpoint of improving dispersion stability of the toner particles, thereby improving storage stability. In particular, 1,2-propanediol is more preferred, from the viewpoint of storage stability. Also, the alkylene oxide adduct of bisphenol A represented by the formula (II) is more preferred, from the viewpoint of pulverizability. The content of 1,2-propanediol or the alkylene oxide adduct of bisphenol A represented by the formula (II) is preferably 50% by mol or more, more preferably 70% by mol or more, even more preferably 90% by mol or more, even more preferably 95% by mol or more, and even more preferably 100% by mol, of the alcohol component. When 1,2-propanediol and the alkylene oxide adduct of bisphenol A represented by the formula (II) are used together, it is preferable that a total content of both is within the above range.

The trihydric or higher polyhydric alcohol includes trihydric or higher polyhydric alcohols having 3 or more carbon atoms and 20 or less carbon atoms, and preferably having 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, or anhydrides thereof, derivatives thereof such as alkyl esters of which alkyl has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and succinic acid substituted with an alkyl group having 1 or more carbon atoms and 20 or less carbon atoms or an alkenyl group having 2 or more carbon atoms and 20 or less carbon atoms.

The carboxylic acid component is preferably terephthalic acid or fumaric acid, and more preferably terephthalic acid, from the viewpoint of improving low-temperature fusing ability of the toner, and from the viewpoint of improving dispersion stability of the toner particles, thereby improving storage stability. The content of the terephthalic acid or a total content of terephthalic acid and fumaric acid is preferably 40% by mol or more, preferably 50% by mol or more, more preferably 70% by mol or more, even more preferably 90% by mol or more, even more preferably 95% by mol or more, and even more preferably 100% by mol, of the carboxylic acid component.

The tricarboxylic or higher polycarboxylic acid compound includes, for example, tricarboxylic or higher polycarboxylic acids having 4 or more carbon atoms and 20 or less carbon atoms, preferably having 6 or more carbon atoms and 20 or less carbon atoms, more preferably having 7 or more carbon atoms and 15 or less carbon atoms, more preferably having 8 or more carbon atoms and 12 or less carbon atoms, and even more preferably having 9 or more carbon atoms and 10 or less carbon atoms, or anhydrides thereof, derivatives thereof such as alkyl esters of which alkyl has 1 or more carbon atoms and 3 or less carbon atoms and the like. Specific examples include 1,2,4-benzenetricarboxylic acid (trimellitic acid), 1,2,4,5-benzenetetracarboxylic acid (pyromellitic acid), or acid anhydrides thereof, and the like.

The content of the tricarboxylic or higher polycarboxylic acid compound is preferably 1% by mol or more, more preferably 2% by mol or more, and even more preferably 3% by mol or more, and preferably 30% by mol or less, more preferably 25% by mol or less, and even more preferably 20% by mol or less, of the carboxylic acid component, from the viewpoint of improving hot offset resistance and improving pulverizability of the toner particles.

Here, the alcohol component may contain a monohydric alcohol, and the carboxylic acid component may contain a monocarboxylic acid compound in proper amounts, from the viewpoint of adjusting a molecular weight and a softening point of the polyester resin.

The equivalent ratio of the carboxylic acid component to the alcohol component in the polyester resin, i.e. COOH group or groups/OH group or groups, is preferably 0.6 or more, more preferably 0.7 or more, and more preferably 0.75 or more, and preferably 1.1 or less, more preferably 1.05 or less, and even more preferably 1 or less, from the viewpoint of adjusting a softening point of the polyester resin.

The polyester resin can be produced, for example, by polycondensing the alcohol component and the carboxylic acid component in an inert gas atmosphere at a temperature of 130° C. or higher and 250° C. or lower, and preferably 170° C. or higher and 240° C. or lower, preferably in the presence of an esterification catalyst, optionally in the presence of an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like, and the tin compounds are preferred. The amount of the esterification catalyst used is preferably 0.01 parts by mass or more, and more preferably 0.1 parts by mass or more, and preferably 1.5 parts by mass or less, and more preferably 1 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes t-butyl catechol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

Here, in the present invention, the polyester resin may be a modified polyester resin to an extent that the properties thereof are not substantially impaired. The modified polyester resin includes, for example, a polyester resin grafted or blocked with a phenol, a urethane, an epoxy or the like according to a method described in Japanese Patent Laid-Open No. Hei-11-133668, Hei-10-239903, Hei-8-20636, or the like. Among them, a polyester resin grafted or blocked with a urethane is preferred.

As a composite resin, a composite resin containing the above polyester resin and a styrenic resin is preferred.

The styrenic resin is a product of addition polymerization of raw material monomers containing at least styrene or a styrene derivative such as α-methylstyrene or vinyltoluene (hereinafter, the styrene and styrene derivatives are collectively referred to as "styrenic compound").

The content of the styrenic compound, preferably styrene, in the raw material monomers for the styrenic resin, is preferably 50% by mass or more, more preferably 70% by mass or more, and even more preferably 80% by mass or more, from the viewpoint of improving dispersion stability of the toner particles, thereby improving storage stability, and the content is preferably 95% by mass or less, more preferably 93% by mass or less, and even more preferably 90% by mass or less, from the viewpoint of improving low-temperature fusing ability of the toner and from the viewpoint of improving wet milling property.

In addition, the styrenic resin may contain an alkyl (meth)acrylate of which alkyl group has 7 or more carbon atoms as a raw material monomer. The alkyl (meth)acrylate includes 2-ethylhexyl (meth)acrylate, (iso)octyl (meth)acrylate, (iso)decyl (meth)acrylate, (iso)stearyl (meth)acrylate, and the like. These alkyl (meth)acrylates are preferably used alone or in two or more kinds. Here, the expression "(iso)" as used herein means to embrace both cases where these groups are present and cases where they are absent, and in the cases where these groups are absent, they are normal form. Also, the expression "(meth)acrylic acid" is acrylic acid, methacrylic acid, or the both.

The number of carbon atoms of the alkyl group in the alkyl (meth)acrylate as the raw material monomers for the styrenic resin is preferably 7 or more, and more preferably 8 or more, from the viewpoint of improving low-temperature fusing ability of the toner, and the number of carbon atoms is preferably 12 or less, and more preferably 10 or less, from the viewpoint of storage stability. Here, the number of carbon atoms of the alkyl ester refers to the number of carbon atoms derived from the alcohol component constituting the ester.

The raw material monomers for styrene resins may contain raw material monomers other than the styrenic compound and the alkyl (meth)acrylate, including, for example, ethylenically unsaturated monoolefins such as ethylene and propylene; diolefins such as butadiene; halovinyls such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; N-vinyl compounds such as N-vinylpyrrolidone; and the like.

The addition polymerization reaction of the raw material monomers for the styrenic resin can be carried out, for example, in the presence of a polymerization initiator such as dicumyl peroxide, a polymerization inhibitor, a crosslinking agent, or the like, and in the presence or an organic solvent or in the absence of a solvent, and the temperature conditions are preferably 110° C. or higher, and more preferably 140° C. or higher, and preferably 200° C. or lower, and more preferably 170° C. or lower.

When an organic solvent is used during the addition polymerization reaction, xylene, toluene, methyl ethyl ketone, acetone or the like can be used. The amount of the organic solvent used is preferably 10 parts by mass or more and 50 parts by mass or less, based on 100 parts by mass of the raw material monomers for the styrenic resin.

In the present invention, it is preferable that the composite resin is a resin in which a polyester resin and a styrenic resin are chemically bonded via a dually reactive monomer, which is capable of reacting with both the raw material monomers for the polyester resin and the raw material monomers for the styrenic resin, from the viewpoint of dispersion stability and pulverizability of the toner particles.

The dually reactive monomer is preferably a compound having within its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond, and the dually reactive monomer is more preferably at least one member selected from the group consisting of acrylic acid, methacrylic acid, fumaric acid, maleic acid, and maleic anhydride, and, from the viewpoint of reactivities of the polycondensation reaction and addition polymerization reaction, even more preferably at least one member selected from the group consisting of acrylic acid, methacrylic acid, and fumaric acid. Here, in a case where the dually reactive monomer is used together with a polymerization inhibitor, a polycarboxylic acid compound having an ethylenically unsaturated bond such as fumaric acid functions as a raw material monomer for a polyester resin. In this case, fumaric acid or the like is not a dually reactive monomer, but a raw material monomer for a polyester resin.

In addition, the dually reactive monomer may be one or more (meth)acrylate esters selected from acrylate esters and methacrylate esters of which alkyl group has 6 or less carbon atoms.

The (meth)acrylate ester is preferably an alkyl (meth) acrylate, from the viewpoint of reactivity to transesterification, and the alkyl group has the number of carbon atoms of preferably 2 or more, and more preferably 3 or more, and preferably 6 or less, and more preferably 4 or less. The alkyl group may have a substituent such as a hydroxyl group.

Specific examples of the alkyl (meth)acrylate include methyl (meth)acrylate, ethyl (meth)acrylate, (iso)propyl (meth)acrylate, 2-hydroxyethyl (meth)acrylate, (iso or tertiary)butyl (meth)acrylate, hexyl (meth)acrylate, and the like. Here, the expression "(iso or tertiary)" means to embrace both cases where these groups are present and cases where they are absent, and in the cases where these groups are absent, they are normal form.

In the present invention, the acrylate ester is preferably an alkyl acrylate of which alkyl group has 2 or more carbon atoms and 6 or less carbon atoms, and more preferably butyl acrylate, and the methacrylate ester is preferably an alkyl methacrylate of which alkyl group has 2 or more carbon atoms and 6 or less carbon atoms, and more preferably butyl methacrylate.

The amount of the dually reactive monomer used, based on 100 mol of a total of the alcohol component of the polyester resin, is preferably 1 mol or more, and more preferably 2 mol or more, from the viewpoint of enhancing dispersibility of the styrenic resin and the polyester resin, thereby improving durability of the toner, and the amount of the dually reactive monomer used is preferably 30 mol or less, more preferably 20 mol or less, and even more preferably 10 mol or less, from the viewpoint of low-temperature fusing temperature.

In addition, the amount of the dually reactive monomer used, based on 100 parts by mass of a total of the raw material monomers for the styrenic resin, is preferably 1 part by mass or more, and more preferably 2 parts by mass or more, from the viewpoint of enhancing dispersibility of the styrenic resin and polyester resin, thereby improving durability of the toner, and the amount of the dually reactive monomer used is preferably 30 parts by mass or less, more preferably 20 parts by mass or less, and even more preferably 10 parts by mass or less, from the viewpoint of low-temperature fusing ability. Here, a total of the raw material monomers for the styrenic resin includes a polymerization initiator.

It is preferable that the composite resin obtained by using a dually reactive monomer is specifically produced in accordance with the following method. It is preferable that the dually reactive monomer is used in the addition polymerization reaction together with the raw material monomers for the styrenic resin, from the viewpoint of improving durability of the toner, and from the viewpoint of improving low-temperature fusing ability and heat-resistant storage property of the toner.

(i) Method including the steps of (A) carrying out a polycondensation reaction of raw material monomers for a polyester resin; and thereafter (B) carrying out an addition polymerization reaction of raw materials monomers for a styrenic resin and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin and the dually reactive monomer are added to a reaction system at a temperature appropriate for an addition polymerization reaction. The dually reactive monomer also reacts with the polyester resin as well as in the addition polymerization reaction.

After the step (B), a reaction temperature is raised again, a raw material monomer which is a trivalent or higher polyvalent monomer for a polyester resin serving as a crosslinking agent is optionally added to the reaction system, whereby the polycondensation reaction of the step (A) and the reaction with the dually reactive monomer can be further progressed.

(ii) Method including the steps of (B) carrying out an addition polymerization reaction of raw material monomers for a styrenic resin and a dually reactive monomer, and thereafter (A) carrying out a polycondensation reaction of raw material monomers for a polyester resin In this method, the step (B) is carried out under reaction temperature conditions appropriate for an addition polymerization reaction, a reaction temperature is then raised, and the step (A) a polycondensation reaction is carried out under temperature conditions appropriate for the polycondensation reaction. The dually reactive monomer is also involved in a polycondensation reaction as well as the addition polymerization reaction.

The raw material monomers for the polyester resin may be present in a reaction system during the addition polymerization reaction, or the raw material monomers for the polyester resin may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including carrying out reactions under the conditions of concurrently progressing the step (A) a polycondensation reaction of raw material monomers for a polyester resin and the step (B) an addition polymerization reaction of raw materials monomers for a styrenic resin and a dually reactive monomer In this method, it is preferable that the steps (A) and (B) are concurrently carried out under reaction temperature conditions appropriate for an addition polymerization reaction, a reaction temperature is raised, a raw material monomer which is a trivalent or higher polyvalent monomer for the polyester resin serving as a crosslinking agent is optionally added to a polymerization system under temperature conditions appropriate for a polycondensation reaction, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) carrying out a polycondensation reaction. In the above method (iii), when the steps (A) and (B) are concurrently progressed, a mixture containing raw material monomers for the styrenic resin can be added dropwise to a mixture containing raw material monomers for the polyester resin to react.

It is preferable that the above methods (i) to (iii) are carried out in a single vessel.

The mass ratio of the styrenic resin to the polyester resin in the composite resin, i.e. styrenic resin/polyester resin, is preferably 3/97 or more, more preferably 7/93 or more, and even more preferably 10/90 or more, from the viewpoint of pulverizability of the toner particles, and the mass ratio is preferably 45/55 or less, more preferably 40/60 or less, even more preferably 35/65 or less, even more preferably 30/70 or less, and even more preferably 25/75 or less, from the viewpoint of dispersion stability of the toner particles. Here, in the above calculation, the mass of the polyester resin is an amount in which the amount of reaction water (calculated value) dehydrated by the polycondensation reaction is subtracted from the mass of the raw material monomers for the usable polyester resin, and the amount of the dually reactive monomer is included in the amount of the raw material monomers for the polyester resin. Also, the amount of the styrenic resin is a total amount of the raw material monomers for the styrenic resin and the polymerization initiator.

The softening point of the polyester-based resin is preferably 70° C. or higher, and more preferably 75° C. or higher, from the viewpoint of improving dispersion stability of the toner particles, thereby improving storage stability, and the softening point is preferably 160° C. or lower, more preferably 130° C. or lower, even more preferably 120° C. or lower, and even more preferably 110° C. or lower, from the viewpoint of improving low-temperature fusing ability of the toner.

The glass transition temperature of the polyester-based resin is preferably 40° C. or higher, and more preferably 45° C. or higher, from the viewpoint of improving dispersion stability of the toner particles, thereby improving storage stability, and the glass transition temperature is preferably 80° C. or lower, more preferably 70° C. or lower, and even more preferably 60° C. or lower, from the viewpoint of improving low-temperature fusing ability.

The acid value of the polyester-based resin is preferably 3 mgKOH/g or more, more preferably 5 mgKOH/g or more, and even more preferably 8 mgKOH/g or more, and preferably 60 mgKOH/g or less, more preferably 50 mgKOH/g or less, even more preferably 40 mgKOH/g or less, and even more preferably 30 mgKOH/g or less, from the viewpoint of reducing viscosity of the liquid developer, and from the viewpoint of improving dispersion stability of the toner particles, thereby improving storage stability. The acid value of the polyester-based resin can be adjusted by a method such as varying an equivalent ratio of the carboxylic acid component to the alcohol component, varying a reaction time during the production of the resin, or varying the content of the tricarboxylic or higher polycarboxylic acid compound.

The content of the polyester-based resin in the resin binder is preferably 90% by mass or more, more preferably 95% by mass or more, and even more preferably 100% by mass, i.e. only the polyester-based resin is used as the resin. However, other resin besides the polyester-based resin may be contained within the range that would not impair the effects of the present invention. The resins besides the polyester-based resin include, for example, one or more members selected from resins such as styrenic resins which are homopolymers or copolymers containing styrene or styrene substitutes, such as polystyrenes, styrene-propylene copolymers, styrene-butadiene copolymers, styrene-vinyl chloride copolymers, styrene-vinyl acetate copolymers, styrene-maleic acid copolymers, styrene-acrylate ester copolymers, and styrene-methacrylate ester copolymers, epoxy resins, rosin-modified maleic acid resins, polyethylene-based resins, polypropylene-based resins, polyurethane-based resins, silicone resins, phenol resins, and aliphatic or alicyclic hydrocarbon resins.

As the colorant, dyes, pigments and the like which are used as colorants for toners can be used. Examples include carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, and the like. In the present invention, the toner particles may be any one of black toners and color toners.

The content of the colorant is preferably 5 parts by mass or more, more preferably 10 parts by mass or more, and even more preferably 15 parts by mass or more, based on 100 parts by mass of the resin binder, from the viewpoint of improving optical density, and the content is preferably 100 parts by mass or less, more preferably 70 parts by mass or less, and even more preferably 50 parts by mass or less, and even more preferably 25 parts by mass or less, based on 100 parts by mass of the resin binder, from the viewpoint of improving pulverizability of the toner, thereby forming smaller particle sizes, from the viewpoint of improving low-temperature fusing ability, and from the viewpoint of improving dispersion stability of the toner particles, thereby improving storage stability.

The toner particles may properly contain, in addition to the resin binder and the colorant, an additive such as a releasing agent, a charge control agent, a charge control resin, a magnetic particulate, a fluidity improver, an electric conductivity modifier, a reinforcing filler such as a fibrous material, an antioxidant, or a cleanability improver.

The method for producing toner particles includes a method including melt-kneading toner raw materials containing a resin binder and a colorant, and pulverizing, preferably wet-milling, the melt-kneaded product obtained, to provide toner particles; a method including mixing an aqueous resin binder dispersion and an aqueous colorant dispersion, thereby unifying the resin binder particles and the colorant particles; a method including stirring an aqueous resin binder dispersion and a colorant at a high speed; and the like. The method including melt-kneading toner raw materials, and pulverizing, preferably wet-milling, the melt-kneaded product obtained is preferred, from the viewpoint of improving developing ability and fusing ability.

First, it is preferable that the toner raw materials containing a resin binder, a colorant, optionally used additives and the like are previously mixed with a mixer such as a Henschel mixer, a Super mixer or a ball-mill, and the mixture is then fed to a kneader, and the Henschel mixer is more preferred, from the viewpoint of improving colorant dispersibility in the resin binder.

The mixing with a Henschel mixer is carried out while adjusting a peripheral speed of agitation, and agitation time. The peripheral speed is preferably 10 m/sec or more and 30 m/sec or less, from the viewpoint of improving colorant dispersibility. In addition, the agitation time is preferably 1 minute or more and 10 minutes or less, from the viewpoint of improving colorant dispersibility.

Next, the melt-kneading of toner raw materials can be carried out with a known kneader, such as a tightly closed kneader, a single-screw or twin-screw kneader, or a continuous open-roller type kneader. In the method for production of the present invention, an open-roller type kneader is preferred, from the viewpoint of improving colorant dispersibility, and from the viewpoint of improving an yield of the toner particles after pulverization.

The open-roller type kneader refers to a kneader of which melt-kneading unit is an open type, not being tightly closed, which can easily dissipate the kneading heat generated during the melt-kneading. The open-roller type kneader used in the present invention is provided with a plurality of feeding ports for raw materials and a discharging port for a kneaded mixture along the shaft direction of the roller, and it is preferable that the open-roller type kneader is a continuous open-roller type kneader, from the viewpoint of production efficiency.

It is preferable that the open-roller type kneader comprises at least two kneading rollers having different temperatures.

It is preferable that the setting temperatures of the rollers are such that the set temperature is equal to or lower than a temperature that is 10° C. higher than the softening point of the resin, from the viewpoint of improving miscibility of the toner raw materials.

In addition, it is preferable that the set temperature of the roller at an upstream side is higher than the set temperature of the roller at a downstream side, from the viewpoint of making the adhesiveness of the kneaded product to the roller at an upstream side favorable and strongly kneading at a downstream side.

It is preferable that the rollers have peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. The peripheral speed of the low-rotation roller is preferably 2 m/min or more, and more preferably 4 m/min or more, and preferably 100 m/min or less, more preferably 60 m/min or less, and even more preferably 50 m/min or less. Also, the ratio of the peripheral speeds of the two rollers, i.e. low-rotation roller/high-rotation roller, is preferably 1/10 or more, and more preferably 3/10 or more, and preferably 9/10 or less, and more preferably 8/10 or less.

In addition, structures, size, materials and the like of each of the rollers are not particularly limited. The surface of the roller comprises a groove used in kneading, and the shapes of grooves include linear, spiral, wavy, rugged or other forms.

Next, the melt-kneaded product is cooled to an extent that is pulverizable, and the cooled product is subjected to a pulverizing step and optionally a classifying step, whereby the toner particles can be obtained.

The pulverizing step may be carried out in divided multi-stages. For example, the melt-kneaded product may be roughly pulverized to a size of from 1 to 5 mm or so, and the roughly pulverized product may then be further finely pulverized. In addition, in order to improve productivity during the pulverizing step, the melt-kneaded product may be mixed with fine inorganic particles made of hydrophobic silica or the like, and then pulverized.

The pulverizer suitably used in the rough pulverization includes, for example, an atomizer, Rotoplex, and the like, or a hammer-mill or the like may be used. In addition, the pulverizer suitably used in the fine pulverization includes a fluidised bed opposed jet mill, an air jet mill, a rotary mechanical mill, and the like.

The classifier usable in the classification step includes an air classifier, a rotor type classifier, a sieve classifier, and the like. Here, the pulverizing step and the classifying step may be repeated as occasion demands.

The toner particles obtained in this step have a volume-median particle size $D_{50}$ of preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ means a particle size of which cumulative volume frequency calculated on a volume percentage is 50% counted from the smaller particle sizes. Here, it is preferable that the toner particles are mixed with a dispersant and an insulating liquid, and then further finely pulverized with wet-milling or the like.

The content of the toner particles, based on 100 parts by mass of the insulating liquid, is preferably 10 parts by mass or more, more preferably 20 parts by mass or more, even more preferably 30 parts by mass or more, even more preferably 40 parts by mass or more, and even more preferably 50 parts by mass or more, from the viewpoint of high-speed printability, and the content is preferably 100 parts by mass or less, more preferably 80 parts by mass or less, even more preferably 70 parts by mass or less, and even more preferably 60 parts by mass or less, from the viewpoint of improving dispersion stability.

The dispersant in the present invention contains a dispersant X having an adsorbing group having a nitrogen-containing group represented by the formula (I):

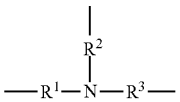

(I)

wherein each of $R^1$, $R^2$, and $R^3$, which may be identical or different, is an alkylene group having 1 or more carbon atoms and 22 or less carbon atoms, an alkenylene group having 2 or more carbon atoms and 22 or less carbon atoms, an alkynylene group having 2 or more carbon atoms and 22 or less carbon atoms, or an arylene group having 6 or more carbon atoms and 22 or less carbon atoms, and a dispersing group having a hydrocarbon group having a number-average molecular weight of 500 or more.

In the formula (I), each of $R^1$, $R^2$, and $R^3$, which may be identical or different, is an alkylene group having 1 or more carbon atoms and 22 or less carbon atoms, preferably 2 or more carbon atoms and 14 or less carbon atoms, and more preferably 2 or more carbon atoms and 6 or less carbon atoms, an alkenylene group having 2 or more carbon atoms and 22 or less carbon atoms, preferably 2 or more carbon atoms and 14 or less carbon atoms, and more preferably 2 or more carbon atoms and 6 or less carbon atoms, an alkynylene group having 2 or more carbon atoms and 22 or less carbon atoms, preferably 2 or more carbon atoms and 14 or less carbon atoms, and more preferably 2 or more carbon atoms and 6 or less carbon atoms, or an arylene group having 6 or more carbon atoms and 22 or less carbon atoms, preferably 2 or more carbon atoms and 17 or less carbon atoms, and more preferably 6 or more carbon atoms and 12 or less carbon atoms. Among them, an alkylene group is preferred.

The alkylene group having 1 or more carbon atoms and 22 or less carbon atoms includes a methylene group, an ethylene group, a propylene group, and the like.

The alkenylene group having 2 or more carbon atoms and 22 or less carbon atoms includes a vinylene group, a propenylene group, a butenylene group, and the like.

The alkynylene group having 2 or more carbon atoms and 22 or less carbon atoms includes an acetynylene group, a propynylene group, a butynylene group, and the like.

The arylene group having 6 or more carbon atoms and 22 or less carbon atoms include a phenylene group, a biphenylene group, a triphenylene group, and the like.

Here, the dispersant X may have a group in which one or two of $R^1$ to $R^3$ are not a divalent group but a hydrogen atom at an end or a central part of the adsorbing group, within the range that would not impair the effects of the present invention.

The proportion of the group represented by the formula (I) in the adsorbing group in a total amount of the group represented by the formula (I) and these groups is preferably 1% by mol or more and 80% by mol or less, and the proportion in which one of $R^1$ to $R^3$ is a hydrogen atom is preferably 1% by mol or more and 80% by mol or less, and the proportion in which two of $R^1$ to $R^3$ are hydrogen atoms is preferably 1% by mol or more and 50% by mol or less. This proportion can be calculated from the C-NMR determination.

In addition, it is preferable that the existing ratio of the group represented by the formula (I) and these groups in the adsorbing group are in a molar ratio of a group in which two of $R^1$ to $R^3$ are hydrogen atoms/(the group represented by the formula (I)+a group in which one of $R^1$ to $R^3$ is hydrogen atoms) of 1/99 or more and 50/50 or less. This molar ratio can be calculated from the H-NMR determination.

The number-average molecular weight of the adsorbing group is preferably 1,000 or more, more preferably 1,500 or more, and even more preferably 2,000 or more, from the viewpoint of adsorbability to the toner particles, and the number-average molecular weight is preferably 15,000 or less, more preferably 10,000 or less, and even more preferably 5,000 or less, from the viewpoint of dispersibility of the toner particles.

The dispersant X may contain an adsorbing group other than the nitrogen-containing group represented by the formula (I) and the group in which one or two of $R^1$ to $R^3$ of the formula (I) are not a divalent group but a hydrogen atom. The adsorbing group includes, but not particularly limited to, for example, a group derived from polyallylamine, polydimethylaminoethyl methacrylate or the like.

A total of the proportion of the nitrogen-containing group represented by the formula (I) and the group in which one or two of $R^1$ to $R^3$ are not a divalent group but a hydrogen atom in all the adsorbing groups, contained in the dispersant X, is preferably 55% by mass or more, and preferably 75% by mass or more, more preferably 85% by mass or more, even more preferably 90% by mass or more, even more preferably 95% by mass or more, and even more preferably 100% by mass. In other words, a dispersant X in which an adsorbing group consists of the nitrogen-containing group represented by the formula (I) and the group in which one or two of $R^1$ to $R^3$ of the formula (I) are not a divalent group but a hydrogen atom is preferred, and a dispersant X in which an adsorbing group consists of the nitrogen-containing group represented by the formula (I).

The hydrocarbon group in the dispersing group includes aliphatic groups such as alkyl groups, alkenyl groups, and alkynyl groups, and the like.

The number-average molecular weight of the hydrocarbon group is 500 or more, preferably 700 or more, and more preferably 900 or more, from the viewpoint of dispersibility, and the number-average molecular weight is preferably 5,000 or less, more preferably 4,000 or less, and even more preferably 3,000 or less, from the viewpoint of adsorbability to the toner particles.

The dispersant X may contain a dispersing group other than the dispersing group having a hydrocarbon group having a number-average molecular weight of 500 or more, so long as the effects of the present invention would not be impaired. The dispersing group includes, but not particularly limited to, for example, dispersing groups having a hydrocarbon group having a number-average molecular weight of less than 500, halogenated hydrocarbon groups having a number-average molecular weight of 500 or more, hydrocarbon groups having a number-average molecular weight of 500 or more, the hydrocarbon groups having a reactive functional group such as a carboxyl group or a hydroxyl group, a group derived from a polyalkyl methacrylate, and the like.

The proportion of the dispersing groups having a hydrocarbon group having a number-average molecular weight of 500 or more in all the dispersing groups, contained in the dispersant X, is 55% by mass or more, preferably 75% by mass or more, more preferably 85% by mass or more, even more preferably 90% by mass or more, even more preferably 95% by mass or more, and even more preferably 100% by mass. In other words, preferred is a dispersant X in which the dispersing group consists of a dispersing group having a hydrocarbon group having a number-average molecular weight 500 or more.

The mass ratio of the adsorbing group to the dispersing group in the dispersant X (adsorbing group/dispersing group) is 1/99 or more, preferably 5/95 or more, and more preferably 10/90 or more, from the viewpoint of adsorbability to the toner particles, and the mass ratio is 42/58 or less, preferably 30/70 or less, and more preferably 20/80 or less, from the viewpoint of dispersion stability of the toner particles. Here, the mass ratio of the adsorbing group and the dispersing group in the dispersant X can be determined by NMR of the dispersant X. Alternatively, in the production of a dispersant X in which a compound to be used for an adsorbing group and a compound to be used for a dispersing group are reacted, the mass ratio of the reacted raw material compounds can be assumed to be the mass ratio of the adsorbing group to the dispersing group (adsorbing group/dispersing group) in the dispersant.

The mass ratio of the adsorbing group having a nitrogen-containing group represented by the formula (I) and the dispersing group having a hydrocarbon group having a number-average molecular weight of 500 or more in the dispersant X (adsorbing group having a nitrogen-containing group represented by the formula (I)/dispersing group having a hydrocarbon group having a number-average molecular weight of 500 or more) is preferably 1/99 or more, more preferably 5/95 or more, and even more preferably 10/90 or more, from the viewpoint of adsorbability to the toner particles, and the mass ratio is preferably 42/58 or less, more preferably 30/70 or less, and even more preferably 20/80, from the viewpoint of dispersion stability of the toner particles.

The number-average molecular weight of the dispersant X is preferably 3,000 or more, more preferably 4,000 or more, and even more preferably 5,000 or more, from the viewpoint of adsorbability to the toner particles, and the number-average molecular weight is preferably 30,000 or less, more preferably 20,000 or less, and even more preferably 10,000 or less, from the viewpoint of dispersion stability of the toner particles.

The dispersant X is preferably, for example, a reaction product of a polyalkyleneimine having a nitrogen-containing group represented by the formula (I), such as polyethyleneimine, and a compound having a hydrocarbon group having a number-average molecular weight of 500 or more and a reactive functional group, such as polyisobutene succinic anhydride, and the dispersant is obtained by reacting both the compounds by a conventional method. The reactive functional group includes a carboxy group, an epoxy group, a formyl group, an isocyanate group, and the like, and among them, a carboxy group or an epoxy group is preferred, from the viewpoint of safety and reactivity. Therefore, as the compound having a reactive functional group, a carboxylic acid-based compound is preferred. The carboxylic acid-based compound includes maleic acid, fumaric acid, anhydrides thereof, or alkyl esters thereof, of which alkyl has 1 or more carbon atoms and 3 or less carbon atoms, and maleic acid or maleic anhydride is preferred, from the viewpoint of reactivity.

The content of the dispersant X is preferably 80% by mass or more, more preferably 90% by mass or more, even more preferably 95% by mass or more, and even more preferably 100% by mass, of the dispersant.

The dispersant other than the dispersant X includes copolymers of alkyl methacrylate/amino group-containing methacrylate, copolymers of α-olefin/vinyl pyrrolidone (Antaron V-216), and the like.

The content of the dispersant X, based on 100 parts by mass of the toner particles, is preferably 0.1 parts by mass or more, more preferably 0.3 parts by mass or more, and even more preferably 0.5 parts by mass or more, from the viewpoint of dispersion stability of the toner particles, and the content is preferably 5 parts by mass or less, more preferably 4 parts by mass or less, and even more preferably 3.5 parts by mass or less, from the viewpoint of chargeability and fusing ability of the toner.

The insulating liquid in the present invention means a liquid through which electricity is less likely to flow, and in the present invention, the conductivity of the insulating liquid is preferably $1.0\times10^{-11}$ S/m or less, and more preferably $5.0\times10^{-12}$ S/m or less, and preferably $1.0\times10^{-13}$ S/m or more.

It is preferable that the insulating liquid in the liquid developer of the present invention is an insulating liquid containing a polyisobutene, from the viewpoint of dispersion stability and chargeability.

The polyisobutene in the present invention refers to a compound obtained by polymerizing isobutene in accordance with a known method, for example, a cationic polymerization method using a catalyst, and thereafter hydrogenating the polymer at a terminal double bond.

The catalyst usable in the cationic polymerization method includes, for example, aluminum chloride, an acidic ion-exchanging resin, sulfuric acid, boron fluoride, and complexes thereof, and the like. In addition, the polymerization reaction can be controlled by adding a base to the above catalyst.

The degree of polymerization of the polyisobutene is preferably 8 or less, more preferably 6 or less, even more preferably 5 or less, even more preferably 4 or less, and even more preferably 3 or less, from the viewpoint of improving low-temperature fusing ability of the toner, and the degree of polymerization is preferably 2 or more, and more preferably 3 or more, from the viewpoint of controlling corona charger contamination.

It is preferable that an unreacted component of isobutane caused during the polymerization reaction or a high-boiling point component having a high degree of polymerization is removed by distillation. The method of distillation includes, for example, a simple distillation method, a continuous distillation method, a steam distillation method, and the like, and these methods can be used alone or in a combination. The apparatuses used in distillation are not particularly limited to in materials, shapes, models, and the like, which include, for example, a distillation tower packed with a filler material such as Raschig ring, shelved distillation towers comprising dish-shaped shelves, and the like. In addition, the theoretical number of shelves showing separating ability of the distillation tower is preferably 10 shelves or more. Besides, as to conditions such as feeding rates to the distillation tower, refluxing ratios, and uptake amounts, the conditions can be appropriately selected depending upon the distillation apparatuses.

Since a formed product obtained by the polymerization reaction has a double bond at a polymerization terminal, a hydrogenated compound is obtained by a hydrogenation reaction. The hydrogenation reaction can be carried out by, for example, contacting with hydrogen under a pressure of from 2 to 10 MPa at a temperature of from 180° to 230° C. using a hydrogenation catalyst such as nickel or palladium.

The boiling point of the polyisobutene is preferably 120° C. or higher, more preferably 140° C. or higher, even more preferably 160° C. or higher, even more preferably 180° C. or higher, even more preferably 200° C. or higher, and even more preferably 220° C. or higher, from the viewpoint of even more improving dispersion stability of the toner particles, thereby improving storage stability, and the boiling point is preferably 300° C. or lower, more preferably 280° C. or lower, and even more preferably 260° C. or lower, from the viewpoint of even more improving low-temperature fusing ability of the toner, and from the viewpoint of even more improving pulverizability of the toner during wet-milling, thereby providing a liquid developer having a smaller particle size.

The content of the polyisobutene is preferably 5% by mass or more, more preferably 20% by mass or more, even more preferably 40% by mass or more, even more preferably 60% by mass or more, and even more preferably 80% by mass or more, of the insulating liquid, from the viewpoint of controlling corona charger contamination.

Commercially available products of the insulating liquid containing a polyisobutene include "NAS-3," "NAS-4," "NAS-5H," hereinabove manufactured by NOF Corporation, and the like. Among them, the commercially available products can be used alone or in a combination of two or more kinds.

Specific examples of the insulating liquid other than the polyisobutene include, for example, aliphatic hydrocarbons, alicyclic hydrocarbons, aromatic hydrocarbons, halogenated hydrocarbons, polysiloxanes, vegetable oils, and the like. Among them, the aliphatic hydrocarbons such as liquid paraffin and isoparaffin are preferred, from the viewpoint of lowering the viscosity of the liquid developer, and from the viewpoint of odor, harmlessness, and costs.

Commercially available products of the aliphatic hydrocarbon include Isopar M manufactured by Exxon Mobile Corporation; Lytol, manufactured by Sonneborn; Cactus N12D and Cactus N14 manufactured by JX Nippon Oil & Energy Corporation, and the like.

The boiling point of the insulating liquid is preferably 120° C. or higher, more preferably 140° C. or higher, even more preferably 160° C. or higher, even more preferably 180° C. or higher, even more preferably 200° C. or higher, and even more preferably 220° C. or higher, from the viewpoint of even more improving dispersion stability of the toner particles, thereby improving storage stability, and the boiling point is preferably 300° C. or lower, more preferably 280° C. or lower, and even more preferably 260° C. or lower, from the viewpoint of even more improving low-temperature fusing ability of the toner, and from the viewpoint of even more improving pulverizability of the toner during wet-milling, thereby providing toner particles having smaller particle sizes. When the insulating liquids are used in combination of two or more kinds, it is preferable that a boiling point of a combined insulating liquid mixture is within the above range.

The viscosity of the insulating liquid at 25° C. is preferably 1 mPa·s or more, and more preferably 1.5 mPa·s or more, from the viewpoint of improving developing ability and from the viewpoint of improving storage stability of the toner particles in the liquid developer, and the viscosity is preferably 100 mPa·s or less, more preferably 50 mPa·s or less, even more preferably 20 mPa·s or less, even more preferably 10 mPa·s or less, and even more preferably 5 mPa·s or less.

The liquid developer is obtained by dispersing toner particles in an insulating liquid in the presence of a dispersant. It is preferable that the toner particles are dispersed in an insulating liquid, and the dispersion is subjected to wet-milling to provide a liquid developer, from the viewpoint of making particle sizes of the toner particles smaller, and from the viewpoint of lowering the viscosity of the liquid developer.

It is preferable that a method for mixing toner particles, an insulating liquid, and a dispersant is a method including stirring the components with an agitation mixer, or the like.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd.; KADY Mill manufactured by KADY International, and the like.

The toner particles are previously dispersed by mixing components with a high-speed agitation mixer, whereby a dispersion of toner particles can be obtained, which in turn improves productivity of a liquid developer by the subsequent wet-milling.

The solid content concentration of the dispersion of toner particles is preferably 20% by mass or more, more preferably 30% by mass or more, and even more preferably 33% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

The wet-milling refers to a method of subjecting toner particles dispersed in an insulating liquid to a method of mechanical milling treatment in the state of dispersion in the insulating liquid.

As the apparatus used, for example, generally used agitation mixers such as anchor blades can be used. Among the agitation mixers, the apparatuses include high-speed agitation mixers such as DESPA manufactured by ASADA IRON WORKS CO., LTD., and T.K. HOMOGENIZING MIXER manufactured by PRIMIX Corporation; pulverizers or kneaders, such as roller mills, beads-mills, kneaders, and extruders; and the like. These apparatuses can be used in a combination of plural apparatuses.

Among these apparatuses, use of beads-mill is preferred, from the viewpoint of making particle sizes of toner particles smaller, from the viewpoint of improving dispersion stability of the toner particles, thereby improving storage stability, and from the viewpoint of lowering the viscosity of the dispersion.

By controlling particle sizes and filling ratios of media used, peripheral speeds of rotors, residence time, or the like in the beads-mill, toner particles having a desired particle size and a particle size distribution can be obtained.

As described above, it is preferable that the liquid developer of the present invention is produced by a method including:

step 1: melt-kneading a resin binder containing a polyester-based resin and a colorant, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer.

The solid content concentration of the liquid developer is preferably 10% by mass or more, more preferably 15% by mass or more, and even more preferably 20% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

The volume-median particle size $D_{50}$ of the toner particles in the liquid developer is preferably 0.5 μm or more, more preferably 1 μm or more, and even more preferably 1.5 μm or more, from the viewpoint of lowering the viscosity of the liquid developer, and the volume-median particle size is preferably 5 μm or less, more preferably 3 μm or less, and even more preferably 2.5 μm or less, from the viewpoint of improving image quality of the liquid developer.

The viscosity of the liquid developer, the solid content concentration of which is 25% by mass, at 25° C. is preferably 3 mPa·s or more, more preferably 5 mPa·s or more, even more preferably 6 mPa·s or more, and even more preferably 7 mPa·s or more, from the viewpoint of improving dispersion stability of the toner particles, thereby improving storage stability, and the viscosity is preferably 50 mPa·s or less, more preferably 40 mPa·s or less, even more preferably 37 mPa·s or less, even more preferably 35 mPa·s or less, even more preferably 32 mPa·s or less, even more preferably 28 mPa·s or less, even more preferably 24 mPa·s or less, even more preferably 20 mPa·s or less, and even more preferably 16 mPa·s or less, from the viewpoint of improving fusing ability of the liquid developer.

The conductivity of the liquid developer, the solid content concentration of which is 25% by mass, at 25° C. is preferably $1.0\times10^{-13}$ S/m or more, more preferably $5.0\times10^{-13}$ S/m or more, and even more preferably $1.0\times10^{-12}$ S/m or more, from the viewpoint of dispersion stability of the toner particles, and the conductivity is preferably $1.0\times10^{-9}$ S/m or less, more preferably $5.0\times10^{-10}$ S/m or less, and even more preferably $1.0\times10^{-10}$ S/m or less, from the viewpoint of chargeability of the toner.

The surface potential of the liquid developer is preferably 0.010 kV or more, more preferably 0.020 kV or more, and even more preferably 0.030 kV or more, from the viewpoint of chargeability of the toner, and the surface potential is preferably 0.3 kV or less, more preferably 0.2 kV or less, and even more preferably 0.15 kV or less, from the viewpoint of dispersion stability of the toner particles.

With regard to the embodiments described above, the present invention further discloses the following liquid developers.

<1> A liquid developer containing toner particles containing a resin binder containing a polyester-based resin and a colorant, a dispersant, and an insulating liquid, wherein the dispersant contains a dispersant X having an adsorbing group having a nitrogen-containing group represented by the formula (I), and a dispersing group having a hydrocarbon group having a number-average molecular weight of 500 or more, and wherein the dispersant X has a mass ratio of the adsorbing group to the dispersing group (adsorbing group/dispersing group) of 1/99 or more and 42/58 or less.

<2> The liquid developer according to the above <1>, wherein the number-average molecular weight of the adsorbing group is 1,000 or more, preferably 1,500 or more, and more preferably 2,000 or more, and 15,000 or less, preferably 10,000 or less, and more preferably 5,000 or less.

<3> The liquid developer according to the above <1> or <2>, wherein the number-average molecular weight of the hydrocarbon group in the dispersing group is 500 or more, preferably 700 or more, and more preferably 900 or more, and 5,000 or less, preferably 4,000 or less, and more preferably 3,000 or less.

<4> The liquid developer according to any one of the above <1> to <3>, wherein the number-average molecular weight of the dispersant X is 3,000 or more, preferably 4,000 or more, and more preferably 5,000 or more, and 30,000 or less, preferably 20,000 or less, and more preferably 10,000 or less.

<5> The liquid developer according to any one of the above <1> to <4>, wherein the dispersant X is a reaction product of a polyalkyleneimine having a nitrogen-containing group represented by the formula (I) and a compound having a hydrocarbon group having a number-average molecular weight of 500 or more and a reactive functional group.

<6> The liquid developer according to any one of the above <1> to <5>, wherein the content of the dispersant X, based on 100 parts by mass of the toner particles, is 0.1 parts by mass or more, preferably 0.3 parts by mass or more, and more preferably 0.5 parts by mass or more, and 5 parts by mass or less, preferably 4 parts by mass or less, and more preferably 3.5 parts by mass or less.

<7> The liquid developer according to any one of the above <1> to <6>, wherein the acid value of the polyester-based resin is 3 mgKOH/g or more, preferably 5 mgKOH/g or more, and more preferably 8 mgKOH/g or more, and 60 mgKOH/g or less, preferably 50 mgKOH/g or less, more preferably 40 mgKOH/g or less, and even more preferably 30 mgKOH/g or less.

<8> The liquid developer according to any one of the above <1> to <7>, wherein the polyester-based resin contains a polyester resin or a composite resin containing a polyester resin and a styrenic resin.

<9> The liquid developer according to the above <8>, wherein the composite resin is a resin in which the polyester resin and the styrenic resin are chemically bonded via a dually reactive monomer, capable of reacting with both raw material monomers for the polyester resin and raw material monomers for the styrenic resin.

<10> The liquid developer according to the above <8> or <9>, wherein the polyester resin is a polyester resin which is a polycondensate of an alcohol component containing a dihydric or higher polyhydric alcohol and a carboxylic acid component containing a dicarboxylic or higher polycarboxylic acid compound.

<11> The liquid developer according to any one of the above <1> to <10>, wherein the insulating liquid contains a polyisobutene.

<12> The liquid developer according to the above <11>, wherein the boiling point of the polyisobutene is 120° C. or higher, preferably 140° C. or higher, more preferably 160° C. or higher, even more preferably 180° C. or higher, even more preferably 200° C. or higher, and even more preferably 220° C. or higher, and 300° C. or lower, preferably 280° C. or lower, and more preferably 260° C. or lower.

<13> The liquid developer according to any one of the above <1> to <12>, wherein the viscosity of the liquid developer, the solid content concentration of which is 25% by mass, at 25° C. is 3 mPa·s or more, preferably 5 mPa·s or more, more preferably 6 mPa·s or more, and even more preferably 7 mPa·s or more, and 50 mPa·s or less, preferably 40 mPa·s or less, more preferably 37 mPa·s or less, even more preferably 35 mPa·s or less, even more preferably 32 mPa·s or less, even more preferably 28 mPa·s or less, even more preferably 24 mPa·s or less, even more preferably 20 mPa·s or less, and even more preferably 16 mPa·s or less.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "DSC210," manufactured by Seiko Instruments Inc., a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Volume-Median Particle Size of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Number-Average Molecular Weight (Mn) of Adsorbing Group Raw Material (Adsorbing Group)]

The number-average molecular weight is obtained by measuring a molecular weight distribution in accordance with a gel permeation chromatography (GPC) method as shown by the following method.

(1) Preparation of Sample Solution

A polyalkyleneimine is dissolved in a solution prepared by dissolving $Na_2SO_4$ in an aqueous 1% acetic acid solution at 0.15 mol/L so as to have a concentration of 0.2 g/100 mL. Next, this solution is filtered with a fluororesin filter "FP-200," manufactured by Sumitomo Electric Industries, Ltd., having a pore size of 0.2 μm, to remove insoluble components, to provide a sample solution.

(2) Molecular Weight Measurements

Using the following measurement apparatus and analyzing column, the measurement is taken by allowing a solution prepared by dissolving $Na_2SO_4$ in an aqueous 1% acetic acid solution at 0.15 mol/L to flow through a column as an eluent at a flow rate of 1 mL per minute, and stabilizing the column in a thermostat at 40° C., and loading 100 μL of a sample solution. The molecular weight of the sample is calculated based on the previously drawn calibration curve. At this time, a calibration curve is drawn from several kinds of standard pullulans, manufactured by SHOWA DENKO CORPORATION, P-5 (Mw $5.9\times10^3$), P-50 (Mw $4.73\times10^4$), P-200 (Mw $2.12\times10^5$), P-800 (Mw $7.08\times10^5$), as standard samples. The values within the parentheses show molecular weights.

Measurement Apparatus: HLC-8320GPC, manufactured by Tosoh Corporation

Analyzing Column; α+α−M+α−M, manufactured by Tosoh Corporation.

[Number-Average Molecular Weight (Mn) of Dispersing Group Raw Material (Dispersing Group)]

(1) Preparation of Sample Solution

A dispersing group raw material is dissolved in tetrahydrofuran so as to have a concentration of 0.5 g/100 mL. Next, this solution is filtered with a fluororesin filter "FP-200," manufactured by Sumitomo Electric Industries, Ltd., having a pore size of 2 μm, to remove insoluble components, to provide a sample solution.

(2) Measurement of Molecular Weight Distribution

Using the following measurement apparatus and analyzing column, the measurement is taken by allowing tetrahydrofuran to flow through a column as an eluent at a flow rate of 1 mL per minute, and stabilizing the column in a thermostat at 40° C., and loading 100 μL of a sample solution. The molecular weight of the sample is calculated based on the previously drawn calibration curve. At this time, a calibration curve is drawn from several kinds of monodisperse polystyrenes, manufactured by Tosoh Corporation, A-500 (Mw $5.0\times10^2$), A-1000 (Mw $1.01\times10^3$), A-2500 (Mw $2.63\times10^3$), A-5000 (Mw $5.97\times10^3$), F-1 (Mw $1.02\times10^4$), F-2 (Mw $1.81\times10^4$), F-4 (Mw $3.97\times10^4$), F-10 (Mw $9.64\times10^4$), F-20 (Mw $1.90\times10^5$), F-40 (Mw $4.27\times10^5$), F-80 (Mw $7.06\times10^5$), and F-128 (Mw $1.09\times10^6$) as standard samples. The values within parenthesis show molecular weights.

Measurement Apparatus: HLC-8220GPC, manufactured by Tosoh Corporation

Analyzing Column: GMHXL+G3000HXL, manufactured by Tosoh Corporation.

[Number-Average Molecular Weight (Mn) of Dispersant]

The number-average molecular weight is obtained by measuring a molecular weight distribution in accordance with a gel permeation chromatography (GPC) method as shown by the following method.

(1) Preparation of Sample Solution

A dispersant is dissolved in chloroform so as to have a concentration of 0.2 g/100 mL. Next, this solution is filtered with a fluororesin filter "FP-200," manufactured by Sumitomo Electric Industries, Ltd., having a pore size of 0.2 μm, to remove insoluble components, to provide a sample solution.

(2) Molecular Weight Measurements

Using the following measurement apparatus and analyzing column, the measurement is taken by allowing a chloroform solution of 1.00 mmol/L FARMIN DM2098 manufactured by Kao Corporation to flow through a column as an eluent at a flow rate of 1 mL per minute, stabilizing the column in a thermostat at 40° C., and loading a 100 μl sample solution thereto. The molecular weight of the sample is calculated based on the previously drawn calibration curve. At this time, a calibration curve is drawn from several kinds of monodisperse polystyrenes, manufactured by Tosoh Corporation, A-500 (Mw: $5.0\times10^2$), A-5000 (Mw: $5.97\times10^3$), F-2 (Mw: $1.81\times10^4$), F-10 (Mw: $9.64\times10^4$), and F-40 (Mw: $4.27\times10^5$) as standard samples. The values within the parentheses show molecular weights.

Measurement Apparatus: HLC-8220GPC, manufactured by Tosoh Corporation

Analyzing Column: K-804L, manufactured by SHOWA DENKO CORPORATION

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in an insulating liquid, taking 20 measurements for conductivity at 25° C. with a non-aqueous conductivity meter "DT-700," manufactured by Dispersion Technology, Inc., and calculating an average thereof. The smaller the numerical figures, the higher the resistance.

[Boiling Point of Insulating Liquid]

Using a differential scanning calorimeter "DSC210," manufactured by Seiko Instruments Inc., a 6.0 to 8.0 g sample is weighed out in an aluminum pan, the temperature of the sample is raised to 350° C. at a heating rate of 10° C./min to measure endothermic peaks. The highest temperature side of the endothermic peak is defined as a boiling point.

[Viscosities at 25° C. of Insulating Liquid and Liquid Developer Solid Content Concentration of which is 25% by Mass]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Solid Content Concentrations of Dispersion of Toner Particles and Liquid Developer]

Ten parts by mass of a sample is diluted with 90 parts by mass of hexane, and the dilution is spun with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues Drying}}{\text{Mass of Sample, Corresponding to 10 Parts by Mass Portion}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C. of 1 mPa·s, under conditions that a particle refractive index is 1.58, imaginary part being 0.1, and a dispersion medium refractive index is 1.42, at a concentration that gives a scattering intensity of from 5 to 15%.

[Conductivity of Liquid Developer]

A 40 mL glass sample vial "Vial with screw cap, No. 7," manufactured by Maruemu Corporation is charged with 25 g of a liquid developer, a solid content of which was 25% by mass. The conductivity is determined by immersing an electrode in the liquid developer, taking 20 measurements for conductivity at 25° C. with a non-aqueous conductivity meter "DT-700," manufactured by Dispersion Technology, Inc., and calculating an average thereof. The smaller the numerical figures, the higher the resistance.

[Surface Potential of Liquid Developer]

An aluminum container having a cylindrical shape of 10 mm diameter and a height of 1 mm filled to the brim with a liquid developer a solid content concentration of which is 25% by mass is placed on a metal plate grounded to earth, and a corona discharge site and a distance between a surface potentiometer and an outermost surface of the sample of 1 mm are set. Under the atmosphere conditions of a temperature of 25° C. and a relative humidity of 50%, the particle charging is conducted for 0.1 seconds by corona discharges from a cast whisker at 6 kV, and immediately thereafter the measurements are taken at the surface potentiometer. The above measurements are conducted using electrostatic diffusion rate analyzer NS-D100 manufactured by Nano Seeds Corporation, and the measurement method is as prescribed in JIS C 61340-2-1.

PRODUCTION EXAMPLE 1 OF RESINS [RESINS A AND B]

A 10-L four-neck flask equipped with a nitrogen inlet tube, a dehydration tube equipped with a fractional distillation tube through which hot water at 98° C. was allowed to flow, a stirrer, and a thermocouple was charged with raw material monomers for a polyester resin and an esterification catalyst as listed in Table 1. The contents were heated to 180° C. and then heated to 210° C. over 5 hours, and the mixture was reacted until a reaction percentage reached 90%, the reaction mixture was further reacted at 8.3 kPa, and the reaction was terminated at a point where a softening point reached an intended value, to provide a polyester resin having the physical properties as listed in Table 1. Here, in Production Examples of Resins, the reaction percentage refers to a value calculated by:

[amount of generated water in reaction (mol)/theoretical amount of generated water (mol)]×100.

PRODUCTION EXAMPLE 2 OF RESIN [RESIN C]

A 10-L four-neck flask equipped with a nitrogen inlet tube, a dehydration tube equipped with a fractional distillation tube through which hot water at 98° C. was allowed to flow, a stirrer, and a thermocouple was charged with raw material monomers for a polyester resin other than trimellitic anhydride and an esterification catalyst as listed in Table 1. The contents were heated to 180° C. and then heated to 210° C. over 5 hours, and the mixture was reacted until a reaction percentage reached 90%, and the reaction mixture was further reacted at 8.3 kPa for one hour. Thereafter, trimellitic anhydride was supplied thereto, and reacted at a normal pressure for one hour, and the reaction was terminated at a point where a softening point reached an intended value, to provide a polyester resin having the physical properties as listed in Table 1.

PRODUCTION EXAMPLE 3 OF RESINS [RESINS D AND E]

A 10-L four-neck flask equipped with a nitrogen inlet tube, a dehydration tube, a stirrer, and a thermocouple was charged with raw material monomers for a polyester resin and an esterification catalyst as listed in Table 1. The contents were reacted at 235° C., and the reaction mixture was reacted until a reaction percentage reached 90%. Further, the reaction mixture was reacted at 8.3 kPa, and a reaction was terminated at a point where a softening point reached an intended value, to provide a polyester resin having the physical properties as listed in Table 1.

PRODUCTION EXAMPLE 4 OF RESIN [RESIN F]

A 10-L four-neck flask equipped with a nitrogen inlet tube, a dehydration tube, a stirrer, and a thermocouple was charged with raw material monomers for a polyester resin other than fumaric acid and trimellitic anhydride and an esterification catalyst as listed in Table 1. The contents were heated with a mantle heater to 230° C., and then reacted at 230° C. for 8 hours, and further reduced pressure to 8.3 kPa and reacted for one hour. The temperature of the reaction mixture was lowered to 170° C., and raw material monomers for a styrenic resin, a dually reactive monomer, and a polymerization initiator as listed in Table 1 were added dropwise from a dropping funnel over one hour. While holding the temperature at 170° C., the addition polymerization reaction was aged for one hour. Thereafter, the reaction mixture was heated to 210° C., and subjected to removal of the raw material monomers for the styrenic resin as listed in Table 1. The contents were heated with a mantle heater to 230° C., and then reacted at 230° C. for 8 hours, and further reduced pressure to 8.3 kPa and reacted thereat for one hour. The temperature of the reaction mixture was lowered to 170° C., and raw material monomers for a styrenic resin, a dually reactive monomer, and a polymerization initiator as listed in Table 1 were added dropwise from a dropping funnel over one hour. While holding the temperature at 170° C., the addition polymerization reaction was aged for one hour. Thereafter, the reaction mixture was heated to 210° C., and subjected to removal of the raw material monomers for the styrenic resin at 8.3 kPa for one hour, and a reaction of a dually reactive monomer and a polyester resin site were carried out. Further, trimellitic anhydride was added thereto at 210° C., and a reaction was carried out until a softening point reached a value as listed in Table 1, to provide a composite resin having the physical properties as listed in Table 1.

TABLE 1

| | | Resin A | Resin B | Resin C | Resin D | Resin E | Resin F | Resin G |
|---|---|---|---|---|---|---|---|---|
| Raw Material Monomers for Polyester Resin | 1,2-Propanediol | 3,640 g (100) | 3,083 g (100) | 3,196 g (100) | — | — | — | — |
| | BPA—PO[1)] | — | — | — | 4,473 g (60) | 4,313 g (60) | 3,357 g (50) | 4,046 g (70) |
| | BPA—EO[2)] | — | — | — | 2,769 g (40) | 2,670 g (40) | 3,117 g (50) | 1,610 g (30) |
| | Terephthalic acid | 6,360 g (80) | 5,387 g (80) | 4,189 g (60) | 2,858 g (78) | 2,898 g (85) | 2,101 g (66) | 1,288 g (47) |
| | Fumaric acid | — | — | — | — | — | 89 g (4) | — |
| | Dodecenylsuccinic anhydride | — | — | — | — | — | — | 791 g (18) |
| | Trimellitic anhydride | — | 530 g (7) | 1,615 g (20) | — | 118 g (3) | 295 g (8) | 729 g (23) |
| Dually Reactive Monomer | Acrylic acid | — | — | — | — | — | 41 (3) | 36 g (3) |
| Esterification Catalyst | Tin(II) 2-ethylhexanoate | 50 g | 50 g | 50 g | 50 g | 50 g | 45 g | 45 g |
| Raw Material Monomers for Styrenic Resin | Styrene | — | — | — | — | — | 749 g (84) | 1,112 g (84) |
| | 2-Ethylhexyl acrylate | — | — | — | — | — | 143 g (16) | 212 g (16) |
| Polymerization Initiator | Dibutyl peroxide | — | — | — | — | — | 54 g | 79 g |
| Polymerization Inhibitor | 4-t-Butyl catechol | — | — | — | — | — | 5 g | — |
| Styrenic Resin/Polyester Resin (Mass Ratio) | | — | — | — | — | — | 10/90 | 15/85 |
| Physical Properties of Resin | Softening Point, ° C. | 87 | 95 | 115 | 80 | 101 | 90 | 113 |
| | Glass Transition Temp., ° C. | 47 | 55 | 63 | 50 | 61 | 50 | 58 |
| | Acid Value, mgKOH/g | 10 | 30 | 30 | 12 | 12 | 18 | 26 |

Note)
The numerical figures inside the parentheses in the raw material monomers for a polyester resin and the dually reactive monomer are expressed by a molar ratio when a total number of moles of alcohol component is defined as 100. Also, the numerical figures inside the parentheses in the raw material monomers for a styrenic resin are expressed by a molar ratio when a total number of moles of the raw material monomers for styrenic resin is defined as 100.
[1)]Polyoxypropylene(2.2)-2,2-bis(4-hydroxyphenyl)propane
[2)]Polyoxyethylene(2.0)-2,2-bis(4-hydroxyphenyl)propane at 8.3 kPa for one hour, and a reaction of a dually reactive monomer and a polyester resin site were carried out. Further, trimellitic anhydride, fumaric acid, and a polymerization inhibitor were added thereto at 210° C., and a reaction was carried out until a softening point reached a value as listed in Table 1, to provide a composite resin having the physical properties as listed in Table 1.

PRODUCTION EXAMPLE 5 OF RESIN [RESIN G]

A 10-L four-neck flask equipped with a nitrogen inlet tube, a dehydration tube, a stirrer, and a thermocouple was charged with raw material monomers for a polyester resin other than trimellitic anhydride and an esterification catalyst Production Example of Dispersants A 2 L four-neck flask equipped with a reflux condenser, a nitrogen inlet tube, a stirrer, a dehydration tube, and a thermocouple was charged with an adsorbing group raw material as listed in Table 2, and the internal of the reaction vessel was replaced with nitrogen gas. While stirring, as a dispersing group raw material a solution prepared by dissolving a polyisobutene succinic anhydride (PIBSA), OLOA15500, manufactured by Chevron Japan Limited, in xylene was added dropwise thereto at room temperature over one hour. After the termination of the dropwise addition, the mixture was held at room temperature for 30 minutes. Thereafter, the internal of the reaction vessel was heated to 150° C. and held thereat for one hour, and then heated to 160° C. and held thereat for one hour. The pressure was reduced to 8.3 kPa at 160° C. to distill off the solvent. The time point at which a peak of acid anhydride ascribed to PIBSA (1,780 $cm^{-1}$) disappears and a peak ascribed to imide bonding (1,700 $cm^{-1}$) is generated according to the IR analysis is defined as a reaction terminal point, to provide each of dispersants A to J shown in Table 2.

TABLE 2

| | | Dispersant A | Dispersant B | Dispersant C | Dispersant D | Dispersant E |
|---|---|---|---|---|---|---|
| Adsorbing Group Raw Material[1)] | Polyethyleneimine (PEI)300 | 20 | — | — | — | — |
| | Polyethyleneimine (PEI)600 | — | 20 | — | — | — |
| | Polyethyleneimine (PEI)1200 | — | — | 20 | — | — |
| | Polyethyleneimine (PEI)1800 | — | — | — | 20 | — |
| | Polyethyleneimine (PEI)10000 | — | — | — | — | 20 |
| | Tetraethylenepentamine (TEP) | — | — | — | — | — |
| | Structure[2)] | branched | branched | branched | branched | branched |
| | Number-Average Molecular Weight | 1,500 | 2,500 | 3,400 | 4,400 | 12,000 |
| Dispersing Group Raw Material | PIBSA (Effective Content: 78% by Mass) | 266 | 197 | 187 | 187 | 177 |
| | Number-Average Molecular Weight | 1,100 | 1,100 | 1,100 | 1,100 | 1,100 |
| Adsorbing Group/Dispersing Group (Mass Ratio) | | 9/91 | 11/89 | 12/88 | 10/90 | 10/90 |
| Solvent | Xylene | 286 | 217 | 207 | 207 | 197 |
| Number-Average Molecular Weight of Dispersant | | 4,500 | 6,700 | 9,800 | 12,000 | 25,000 |

| | | Dispersant F | Dispersant G | Dispersant H | Dispersant I | Dispersant J |
|---|---|---|---|---|---|---|
| Adsorbing Group Raw Material[1)] | Polyethyleneimine (PEI)300 | 105 | — | — | 60 | — |
| | Polyethyleneimine (PEI)600 | — | — | — | — | 90 |
| | Polyethyleneimine (PEI)1200 | — | — | — | — | — |
| | Polyethyleneimine (PEI)1800 | — | — | 100 | — | — |
| | Polyethyleneimine (PEI)10000 | — | — | — | — | — |
| | Tetraethylenepentamine (TEP) | — | 20 | — | — | — |
| | Structure[2)] | branched | linear | branched | branched | branched |
| | Number-Average Molecular Weight | 1,500 | 189 | 4,400 | 1,500 | 1,500 |
| Dispersing Group Raw Material | PIBSA (Effective Content: 78% by Mass) | 195 | 300 | 128 | 308 | 269 |
| | Number-Average Molecular Weight | 1,100 | 1,100 | 1,100 | 1,100 | 1,100 |
| Adsorbing Group/Dispersing Group (Mass Ratio) | | 41/59 | 8/92 | 50/50 | 20/80 | 30/70 |
| Solvent | Xylene | 300 | 320 | 228 | 368 | 299 |
| Number-Average Molecular Weight of Dispersant | | 2,800 | 1,800 | Undeterminable due to being insoluble | 3,700 | 3,200 |

Note)

The amount used is in mass ratio.

[1)]Polyethyleneimine 300, 600, 1200, 1800, and 10000: all are manufactured by JUNSEI CHEMICAL CO., LTD., tetraethylenepentamine: manufactured by KANTO CHEMICAL CO., INC.

[2)]branched: with an adsorbing group having a nitrogen-containing group represented by the formula (I) linear: without an adsorbing group having a nitrogen-containing group represented by the formula (I)

[Mass Ratio of Adsorbing Group to Dispersing Group in Dispersant]

In the production of the above dispersant, since it can be confirmed that the adsorbing group raw material and the dispersing group raw material are completely reacted, the mass ratio of the adsorbing group raw material to the dispersing group raw material which are used (adsorbing group raw material/dispersing group raw material) can be assumed to be the mass ratio of the adsorbing group to the dispersing group in the dispersant.

EXAMPLES 1 to 13 AND COMPARATIVE EXAMPLES 1 to 3

Eighty-five parts by mass of a resin binder as listed in Tables 3 and 4 and 15 parts by mass of a colorant "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec), and the mixture was melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a peripheral speed of a high-rotation roller (front roller) of 75 r/min (32.4 m/min), a peripheral speed of a low-rotation roller (back roller) of 35 r/min (15.0 m/min), and a gap between the rollers at an end of the kneaded product supplying side of 0.1 mm. The temperatures of the heating medium and the cooling medium inside the rollers were as follows. The high-rotation roller had a temperature at the raw material supplying side of 90° C., and a temperature at the kneaded product-discharging side of 85° C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was roughly pulverized with a hammer-mill to a size of 1 mm or so, and then finely pulverized and classified with an air jet type jet mill "IDS," manufactured by Nippon Pneumatic Mfg. Co., Ltd., to provide toner particles having a volume-median particle size $D_{50}$ of 10 μm.

A 2-L polyethylene vessel was charged with 100 parts by mass of toner particles, a dispersant as listed in Table 3 or 4 adjusted in an amount so that an effective content would be 3 parts by mass, and 191 parts by mass of an insulating liquid "NAS-4" manufactured by NOF Corporation (conductivity: $1.5\times10^{-12}$ S/cm, boiling point: 247° C., viscosity: 2.0 mPa·s), and the contents were stirred with "T.K. ROBOMIX," manufactured by PRIMIX Corporation, under ice-cooling at a rotational speed of 7,000 r/min for 30 minutes, to provide a dispersion of toner particles, a solid content concentration of which was 35% by mass.

Next, the dispersion of toner particles obtained was subjected to wet-milling for 4 hours with 6 vessels-type sand grinder "TSG-6," manufactured by AIMEX CO., LTD., at a rotational speed of 1,300 r/min (peripheral speed 4.8 m/sec) using zirconia beads having a diameter of 0.8 mm at a volume filling ratio of 60% by volume. The beads were removed by filtration, and the filtrate was diluted with the insulating liquid to provide a liquid developer, a solid content concentration of which was 25% by mass, having physical properties as shown in Table 3 or 4.

Test Example [Dispersion Stability]

A 20 mL glass sample vial "Vial with screw cap, No. 5," manufactured by Maruemu Corporation was charged with 10 g of a liquid developer, and then stored in a thermostat held at 50° C. for 24 hours. The volume-median particle sizes $D_{50}$ of the toner particles before and after the storage were determined, and the dispersion stability was evaluated from the value of a difference thereof, i.e. [$D_{50}$ After Storage−$D_{50}$ Before Storage]. The results are shown in Tables 3 and 4. The more the numerical values approximates 0, the more excellent the dispersion stability.

TABLE 3

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Toner Particles | Resin Binder | Resin A | Resin A | Resin A | Resin A | Resin A | Resin B | Resin C | Resin D |
| | Acid Value of Resin Binder, mgKOH/g | 10 | 10 | 10 | 10 | 10 | 30 | 30 | 12 |
| Dispersant | Dispersant | A | B | C | D | E | B | B | B |
| | Adsorbing Group Raw Material | PEI300 | PEI600 | PEI1200 | PEI1800 | PEI10000 | PEI600 | PEI600 | PEI600 |
| | Structure of Adsorbing Group | branched | branched | branched | branched | branched | branched | branched | branched |
| | Mn of Adsorbing Group | 1,500 | 2,500 | 3,400 | 4,400 | 12,000 | 2,500 | 2,500 | 2,500 |
| | Dispersing Group Raw Material | PIBSA | PIBSA | PIBSA | PIBSA | PIBSA | PIBSA | PIBSA | PIBSA |
| | Mn of Dispersing Group | 1,100 | 1,100 | 1,100 | 1,100 | 1,100 | 1,100 | 1,100 | 1,100 |
| | Adsorbing Group/ Dispersing Group (Mass Ratio) | 9/91 | 11/89 | 12/88 | 10/90 | 10/90 | 11/89 | 11/89 | 11/89 |
| Liquid Developer | $D_{50}$ of Toner Particles, μm | 1.8 | 2.0 | 2.2 | 2.3 | 2.5 | 2.2 | 2.8 | 2.3 |
| | Viscosity, mPa · s | 7 | 6 | 8 | 10 | 12 | 15 | 28 | 13 |
| | Conductivity, S/m | $9.9\times10^{-11}$ | $8.0\times10^{-11}$ | $2.3\times10^{-11}$ | $8.6\times10^{-12}$ | $4.3\times10^{-12}$ | $4.5\times10^{-11}$ | $2.3\times10^{-11}$ | $5.6\times10^{-11}$ |
| | Surface Potential, kV | 0.039 | 0.055 | 0.089 | 0.099 | 0.134 | 0.096 | 0.156 | 0.044 |
| | Dispersion Stability, μm | 2.5 | 2.0 | 2.2 | 2.3 | 2.5 | 2.2 | 2.8 | 2.3 |

TABLE 4

| | | Ex. 9 | Ex. 10 | Ex. 11 | Ex. 12 | Ex. 13 | Comp. Ex. 1 | Comp. Ex. 2 | Comp. Ex. 3 |
|---|---|---|---|---|---|---|---|---|---|
| Toner Particles | Resin Binder | Resin D/ Resin E = 50/50 | Resin F/ Resin G = 50/50 | Resin D/ Resin E = 50/50 | Resin D/ Resin E = 50/50 | Resin D/ Resin E = 50/50 | Resin F/ Resin G = 50/50 | Resin F/ Resin G = 50/50 | Resin F/ Resin G = 50/50 |
| | Acid Value of Resin Binder, mgKOH/g | 12 | 22 | 12 | 12 | 12 | 22 | 22 | 22 |
| Dispersant | Dispersant | Dispersant B | Dispersant B | Dispersant I | Dispersant J | Dispersant F | Dispersant G | SOLSPARSE 13940 | Dispersant H |
| | Adsorbing Group Raw Material | PEI600 | PEI600 | PEI300 | PEI600 | PEI300 | TEP | PEI | PEI |
| | Structure of Adsorbing Group | branched | branched | branched | branched | branched | Linear | branched | branched |

TABLE 4-continued

| | | Ex. 9 | Ex. 10 | Ex. 11 | Ex. 12 | Ex. 13 | Comp. Ex. 1 | Comp. Ex. 2 | Comp. Ex. 3 |
|---|---|---|---|---|---|---|---|---|---|
| | Mn of Adsorbing Group | 2500 | 2500 | 1500 | 1500 | 1500 | 189 | 9400 | 4400 |
| | Dispersing Group Raw Material | PIBSA | PIBSA | PIBSA | PIBSA | PIBSA | PIBSA | p-12HSA | PIBSA |
| | Mn of Dispersing Group | 1,100 | 1,100 | 1,100 | 1,100 | 1,100 | 1,100 | 1,600 | 1,100 |
| | Adsorbing Group/ Dispersing Group (Mass Ratio) | 11/89 | 11/89 | 20/80 | 30/70 | 41/59 | 8/92 | 27/73 | 50/50 |
| Liquid Developer | $D_{50}$ of Toner Particles, μm | 2.8 | 2.5 | 3.0 | 3.5 | 3.8 | 2.3 | 3.5 | 25 |
| | Viscosity, mPa · s | 18 | 6 | 20 | 22 | 24 | 6 | 36 | 35 |
| | Conductivity, S/m | $6.8 \times 10^{-11}$ | $3.5 \times 10^{-11}$ | $6.5 \times 10^{-11}$ | $3.5 \times 10^{-11}$ | $3.8 \times 10^{-11}$ | $3.3 \times 10^{-9}$ | $5.0 \times 10^{-11}$ | $4.60 \times 10^{-11}$ |
| | Surface Potential, kV | 0.035 | 0.045 | 0.038 | 0.045 | 0.034 | 0.006 | 0.087 | 0.001 |
| | Dispersion Stability, μm | 2.8 | 2.5 | 3.0 | 3.5 | 3.8 | Solidified and undeter-minable | 19 | Solidified and undeter-minable. |

Note

1) Acid value of the resin binder is a weighted average value.

Note

2) SOLSPARSE 13940: manufactured by Lubrizol Corporation, a condensate of a polyethyleneimine and 12-hydroxystearic acid (p-12HSA) having a degree of polymerization of 3.5, an effective content: 40% by mass It can be seen from the above results that the liquid developers of Examples 1 to 13 have excellent chargeability and dispersion stability.

On the other hand, it can be seen that the liquid developer of Comparative Example 1 in which the adsorbing group of the dispersant has a linear structure, not a branched structure is deficient in chargeability and dispersion stability, and that the liquid developer of Comparative Example 2 in which the dispersing group of the dispersant is not a hydrocarbon group and the liquid developer of Comparative Example 3 in which the proportion of the adsorbing group in the dispersant is too large are especially deficient in dispersion stability.

The liquid developer of the present invention is suitably used in development or the like of latent images formed in, for example, electrophotography, electrostatic recording method, electrostatic printing method or the like.

The invention claimed is:

1. A liquid developer comprising toner particles comprising a resin binder comprising a polyester-based resin and a colorant, a dispersant, and an insulating liquid, wherein the dispersant comprises a dispersant X having an adsorbing group having a nitrogen-containing group represented by the formula (I):

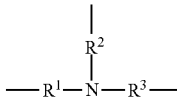

(I)

wherein each of $R^1$, $R^2$, and $R^3$, which may be identical or different, is an alkylene group having 1 or more carbon atoms and 22 or less carbon atoms, an alkenylene group having 2 or more carbon atoms and 22 or less carbon atoms, an alkynylene group having 2 or more carbon atoms and 22 or less carbon atoms, or an arylene group having 6 or more carbon atoms and 22 or less carbon atoms, and a dispersing group having a hydrocarbon group having a number-average molecular weight of 500 or more, and wherein the dispersant X has a mass ratio of the adsorbing group to the dispersing group (adsorbing group/dispersing group) of 1/99 or more and 42/58 or less, and a proportion of the dispersing group having a hydrocarbon group having a number-average molecular weight of 500 or more in all the dispersing groups of 55% by mass or more.

2. The liquid developer according to claim 1, wherein the number-average molecular weight of the adsorbing group is 1,000 or more and 15,000 or less.

3. The liquid developer according to claim 1, wherein the number-average molecular weight of the hydrocarbon group in the dispersing group is 500 or more and 5,000 or less.

4. The liquid developer according to claim 1, wherein the dispersing group consists of a dispersing group having a hydrocarbon group having a number-average molecular weight of 500 or more.

5. The liquid developer according to claim 1, wherein the number-average molecular weight of the dispersant X is 3,000 or more and 30,000 or less.

6. The liquid developer according to claim 1, wherein the dispersant X is a reaction product of a polyalkyleneimine having a nitrogen-containing group represented by the formula (I) and a compound having a hydrocarbon group having a number-average molecular weight of 500 or more and having a reactive functional group.

7. The liquid developer according to claim 1, wherein the content of the dispersant X is from 0.1 to 5 parts by mass, based on 100 parts by mass of the toner particles.

8. The liquid developer according to claim 1, wherein the acid value of the polyester-based resin is 3 mgKOH/g or more and 60 mgKOH/g or less.

9. The liquid developer according to claim 1, wherein the polyester-based resin comprises a polyester resin or a composite resin comprising a polyester resin and a styrenic resin.

10. The liquid developer according to claim 9, wherein the composite resin is a resin in which the polyester resin and the styrenic resin are chemically bonded via a dually reactive monomer, capable of reacting with both raw material monomers for the polyester resin and raw material monomers for the styrenic resin.

11. The liquid developer according to claim 9, wherein the polyester resin is a polyester resin which is a condensate of an alcohol component comprising a dihydric or higher polyhydric alcohol and a carboxylic acid component comprising a dicarboxylic or higher carboxylic acid compound.

12. The liquid developer according to claim 1, wherein the insulating liquid comprises a polyisobutene having a boiling point of 200° C. or higher.

13. The liquid developer according to claim 1, wherein the viscosity at 25° C. of the liquid developer, a solid content concentration of which is 25% by mass, is 3 mPa·s or more and 50 mPa·s or less.

14. The liquid developer according to claim 6, wherein the polyalkyleneimine having a nitrogen-containing group represented by the formula (I) is polyethyleneimine.

15. The liquid developer according to claim 6, wherein the compound having a hydrocarbon group having a number-average molecular weight of 500 or more and a reactive functional group is polyisobutene succinic anhydride.

16. The liquid developer according to claim 1, wherein in the formula (I), the alkylene group having 1 or more carbon atoms and 22 or less carbon atoms is a methylene group, an ethylene group, or a propylene group, the alkenylene group having 2 or more carbon atoms and 22 or less carbon atoms is a vinylene group, a propenylene group, or a butenylene group, the alkynylene group having 2 or more carbon atoms and 22 or less carbon atoms is an acetynylene group, propynylene group, or a butynylene group, and the aryl ene group having 6 or more carbon atoms and 22 or less carbon atoms is a phenylene group, a biphenylene group, or a triphenylene group.

17. The liquid developer according to claim 1, wherein the viscosity at 25° C. of the insulating liquid is 1 mPa·s or more and 100 mPa·s or less.

18. The liquid developer according to claim 1, wherein the volume-median particle size of the toner particles is 0.5 μm or more and 5μμm or less.

19. The liquid developer according to claim 1, wherein the solid content concentration is 10% by mass or more and 50% by mass or less.

20. The liquid developer according to claim 1, which is produced by a method comprising:

(a) melt-kneading a resin binder comprising a polyester-based resin and a colorant, and pulverizing the mixture, to obtain toner particles;

(b) adding a dispersant comprising a dispersant X to the toner particles obtained in (a), and dispersing the toner particles in an insulating liquid, to obtain a dispersion of toner particles; and (c) subjecting the dispersion of toner particles obtained in (b) to wet-milling to obtain a liquid developer.

* * * * *